US010602905B2

(12) United States Patent
Li et al.

(10) Patent No.: US 10,602,905 B2
(45) Date of Patent: Mar. 31, 2020

(54) HEAT PUMP AND DISHWASHER COMPRISING THE SAME

(71) Applicant: FOSHAN SHUNDE MIDEA WASHING APPLIANCES MFG. CO., LTD.

(72) Inventors: Xiang Li, Foshan (CN); Canhua Qiu, Foshan (CN); Pingping Xu, Foshan (CN); Feng Gao, Foshan (CN)

(73) Assignee: FOSHAN SHUNDE MIDEA WASHING APPLIANCES MFG. CO. LT, Foshan (CN)

( * ) Notice: Subject to any disclaimer, the term of this patent is extended or adjusted under 35 U.S.C. 154(b) by 344 days.

(21) Appl. No.: 15/124,446

(22) PCT Filed: Jan. 12, 2015

(86) PCT No.: PCT/CN2015/070556
§ 371 (c)(1),
(2) Date: Sep. 8, 2016

(87) PCT Pub. No.: WO2015/161685
PCT Pub. Date: Oct. 29, 2015

(65) Prior Publication Data

US 2017/0027405 A1 Feb. 2, 2017

(30) Foreign Application Priority Data

Apr. 24, 2014 (CN) ..... 2014 1 0168570
Jun. 18, 2014 (CN) ..... 2014 2 0326162 U

(51) Int. Cl.
*A47L 15/08* (2006.01)
*F04D 29/58* (2006.01)
(Continued)

(52) U.S. Cl.
CPC ..... *A47L 15/08* (2013.01); *A47L 15/4225* (2013.01); *A47L 15/4285* (2013.01);
(Continued)

(58) Field of Classification Search
None
See application file for complete search history.

(56) References Cited

U.S. PATENT DOCUMENTS

2001/0042560 A1* 11/2001 Steck ..... A47L 15/4225 134/107
2006/0011221 A1 1/2006 Schrott
(Continued)

FOREIGN PATENT DOCUMENTS

CN 101096953 A 1/2008
CN 201182014 Y 1/2009
(Continued)

OTHER PUBLICATIONS

Jiong Wen, Jan. 14, 2009, Heating pipe of bowl washer, CN201182014(Y) translation (Year: 2009).*
(Continued)

*Primary Examiner* — Cristi J Tate-Sims
(74) *Attorney, Agent, or Firm* — Scully Scott Murphy & Presser

(57) ABSTRACT

A heat pump for a dishwasher includes a pump casing, a motor (20) having a rotatable shaft 201 extended into a chamber of the pump casing, an impeller (30) disposed within the chamber, a heating assembly (40) and a pressure switch assembly (50). The heating assembly includes a heating pipe (41) disposed in the chamber, a fuse (42), and a heater wire disposed in the heating pipe. The heating pipe includes an arc-shaped portion (411), and first and second linear portions (412, 413). The fuse is disposed in at least one of the first and second linear portions and is remote from
(Continued)

the arc-shaped portion, and an extending part (302) of the impeller is encircled by and spaced apart from the arc-shaped portion. A dishwasher including the heat pump is also provided.

20 Claims, 4 Drawing Sheets

(51) Int. Cl.
*A47L 15/42* (2006.01)
*F04D 29/22* (2006.01)
*F04D 29/42* (2006.01)

(52) U.S. Cl.
CPC ..... *F04D 29/22* (2013.01); *F04D 29/2216* (2013.01); *F04D 29/426* (2013.01); *F04D 29/588* (2013.01); *F05D 2250/51* (2013.01)

(56) References Cited

U.S. PATENT DOCUMENTS

| | | | |
|---|---|---|---|
| 2008/0044168 | A1 | 2/2008 | Eichholz et al. |
| 2010/0126534 | A1 | 5/2010 | Busing et al. |
| 2010/0232990 | A1 | 9/2010 | Marioni |
| 2012/0263581 | A1 | 10/2012 | Li et al. |
| 2013/0108252 | A1 | 5/2013 | Liu et al. |
| 2013/0230416 | A1 | 9/2013 | Verma et al. |
| 2013/0343935 | A1 | 12/2013 | Hoj et al. |
| 2014/0193260 | A1 | 7/2014 | Block et al. |

FOREIGN PATENT DOCUMENTS

| | | | |
|---|---|---|---|
| CN | 101657137 | A | 2/2010 |
| CN | 101725569 | A | 6/2010 |
| CN | 101832274 | A | 9/2010 |
| CN | 201754627 | U | 3/2011 |
| CN | 102748329 | A | 10/2012 |
| CN | 103089710 | A | 5/2013 |
| CN | 103443469 | A | 12/2013 |
| CN | 103702601 | A | 4/2014 |
| CN | 203835807 | U | 9/2014 |
| CN | 203953591 | U | 11/2014 |
| DE | 29800704 | U1 | 5/1999 |
| EP | 0898928 | A1 | 3/1999 |
| EP | 1247993 | A2 | 10/2002 |
| WO | 9619672 | A1 | 6/1996 |

OTHER PUBLICATIONS

Elpag Ag Chur, May 20, 1995, DE29800704(U1) translation (Year: 1999).*

EP1247993 A2, Pump, in particular centrifugal circulating pump for household appliances using water, 2002 (Year: 2002).*

Espacenet translation of CN20385807U, heating pump for a dishwasher, 2014 (Year: 2014).*

International Searching Authority, International Search Report for PCT/CN2015/070556 dated Apr. 21, 2015.

ISA/CN, International Search Report and Written Opinion for International Application No. PCT/CN2015/070556 dated Apr. 21, 2015.

EPO, Office Action for EP Application No. 15783017 dated Nov. 14, 2017.

First Office Action dated Mar. 15, 2019 received in Chinese Patent Application No. CN 201810240903.5 together with an English language translation.

Communication pursuant to Article 94(3) EPC dated Oct. 8, 2019 received in European Patent Application No. 15 783 017.5.

* cited by examiner

HEAT PUMP AND DISHWASHER COMPRISING THE SAME

CROSS-REFERENCE TO RELATED APPLICATIONS

This application is a National Phase of International patent application no. PCT/CN2015/070556, filed Jan. 12, 2015, which claims the benefit of Chinese Application No. 201410168570.1 filed on Apr. 24, 2014 and Chinese Application No. 201420326162.X filed on Jun. 18, 2014, the disclosures of each of which are incorporated herein by reference.

FIELD

Embodiments of the present disclosure relate to household appliances, and more particularly to a heat pump for a dishwasher and a dishwasher including the heat pump.

BACKGROUND

A fluid pump in the related art generally includes a pump casing containing upper and lower pump casings, an impeller mounted in the pump casing, a motor for driving the impeller to revolve, as well as a heating element for heating the fluid. In a conventional heat pump, the heating element is mounted in the interior of the pump casing or is a part of the pump casing, such as the upper pump casing or the lower pump casing. Because the heating element mounted in the interior of the pump casing (such as a circular heating pipe) is required to be wound between an outer side of the impeller and the pump casing, the volume of the pump casing is increased and the pump efficiency is reduced. In addition, due to the lack of protection apparatus of the heating pipe, the heat pump may not pass an abnormal condition test, such as a drying test of heating pipe. As for a heat pump with a heating element being a part of the pump casing, because the pump casing must have good sealing performances and heat resistance, the pump casing and the heating pipe may have relatively more complex structures, and costs for the manufacturing and assembling are relatively higher.

SUMMARY

Embodiments of the present disclosure seek to solve at least one of the problems existing in the prior art.

Embodiments of an aspect of the present disclosure provide a heat pump for a dishwasher. The heat pump for a dishwasher according to embodiments of the present disclosure includes: a pump casing having a chamber defined with an inlet and an outlet; a motor connected with the pump casing and having a rotatable shaft extended into the chamber; an impeller disposed within the chamber and arranged on the rotatable shaft, which includes a body part and an extending part having a diameter smaller than that of the body part; a heating assembly including a heating pipe disposed in the chamber, a fuse, and a heater wire disposed in the heating pipe, in which the heating pipe includes an arc-shaped portion defining a first end and a second end, a first linear portion defining an upper end and a lower end connected with the first end of the arc-shaped portion, and a second linear portion defining an upper end and a lower end connected with the second end of the arc-shaped portion, the upper ends of the first and second linear portions are extended out of the pump casing, the fuse is disposed in at least one of the first and second linear portions and is remote from the arc-shaped portion, and the extending part is encircled by and spaced apart from the arc-shaped portion; and a pressure switch assembly arranged on an outer wall of the pump casing and connected with the heating assembly.

With the heat pump for a dishwasher according to embodiments of the present disclosure, the extending part is surrounded by and spaced apart from the arc-shaped portion, and the fuse is disposed in at least one of the first and second linear portions and is remote from the arc-shaped portion, thus reducing a length of the linear portion (such as the first linear portion or the second linear portion), and thereby reducing a volume of the heat pump for a dishwasher.

In some embodiments, the heater wire is disposed in the arc-shaped portion.

In some embodiments, the heating assembly further includes a sealing member and a mounting piece via which the heating pipe is mounted on the pump casing; and the sealing member and the mounting piece are penetrated by the upper ends of the first and second linear portions.

In some embodiments, a mounting part is disposed on an outer wall of the pump casing, which includes a first through hole through which upper ends of the first and second linear portions are penetrated, in which the sealing member and the mounting piece are disposed on inner and outer walls of the pump casing respectively and fixed on the pump casing via a bolt penetrating through the sealing member, the pump casing, and the mounting piece in turn.

In some embodiments, the heating assembly further includes a first connecting terminal which is disposed on the upper end of the first linear portion and connected with the heater wire via a first wire; and a second connecting terminal which is disposed on the upper end of the second linear portion and connected with the heater wire via a second wire, in which the fuse is connected with at least one of the first and second wires.

In some embodiments, the pump casing includes an upper pump casing formed with the inlet and the outlet, and a lower pump casing detachable connected with the upper pump casing, and the upper pump casing is flame retardant with the heating pipe being disposed therein.

In some embodiments, a plurality of snapping members are formed on an outer wall of the upper pump casing circumferentially along the pump casing, a plurality of corresponding snapping grooves adapted to be mated with the plurality of the snapping members respectively are formed in an inner wall of the lower pump casing circumferentially along the pump casing.

In some embodiments, an upper surface of each snapping member includes an inclined portion and a flat portion connected with the inclined portion.

In some embodiments, a sealing ring is disposed between the upper and lower pump casings; and a sealing frame is disposed between the lower pump casing and the impeller, which is defined with a second through hole through which the rotatable shaft is penetrated.

Embodiments of another aspect of the present disclosure provide a dishwasher. The dishwasher according to embodiments of the present disclosure includes a heat pump described above.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
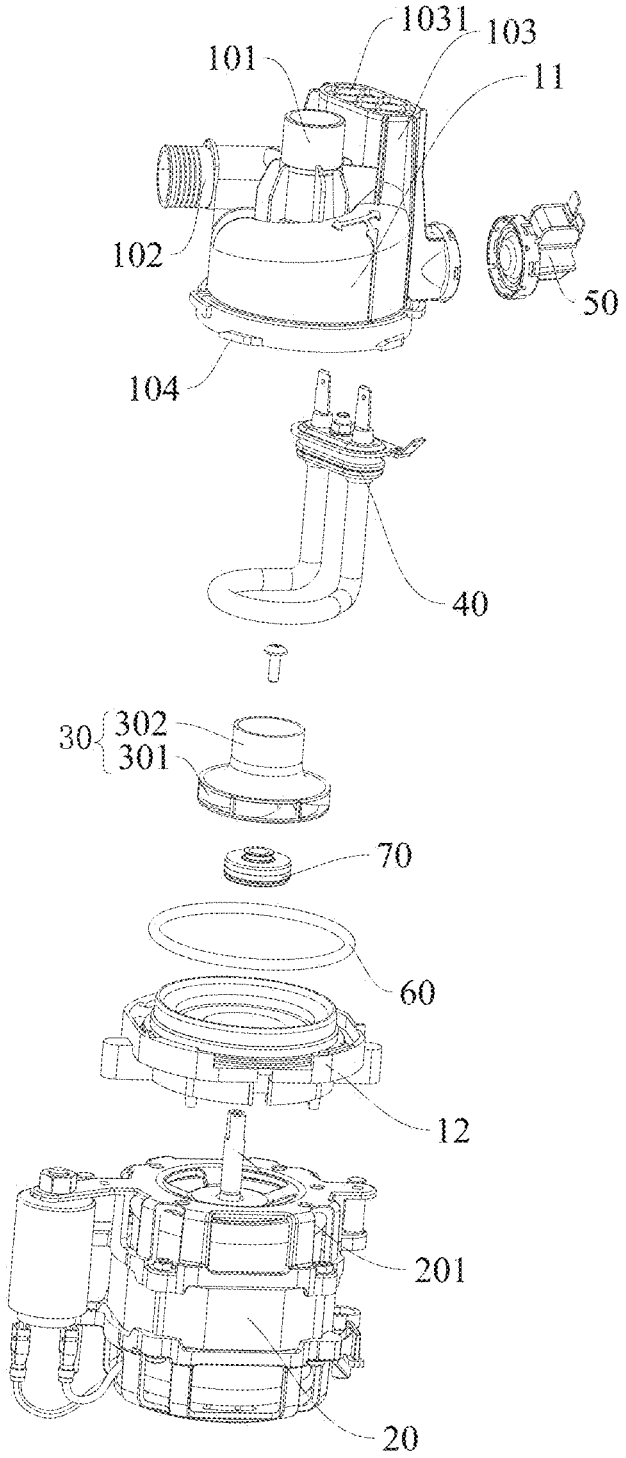
FIG. 1 is a schematic view of a heat pump for a dishwasher according to an embodiment of the present disclosure.

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

A heat pump for a dishwasher according to embodiments of the present disclosure may be described below with reference to the drawings.

In some embodiments, as shown in FIGS. 1-5, a heat pump for a dishwasher includes a pump casing, a motor 20, an impeller 30, a heating assembly 40, and a pressure switch assembly 50.

In some embodiments, a chamber is formed in the interior of the pump casing (not shown). The chamber has an inlet 101 and an outlet 102.

In some embodiments, the motor 20 has a rotatable shaft 201 and is connected with the pump casing. The rotatable shaft 201 extends into the chamber.

In some embodiments, the impeller 30 is disposed within the chamber and arranged on the rotatable shaft 201. The impeller 30 includes a body part 301 and an extending part 302 connected with the body part 301. In some embodiments, the diameter of the extending part 302 is smaller than the diameter of the body part 301.

Figure 3:
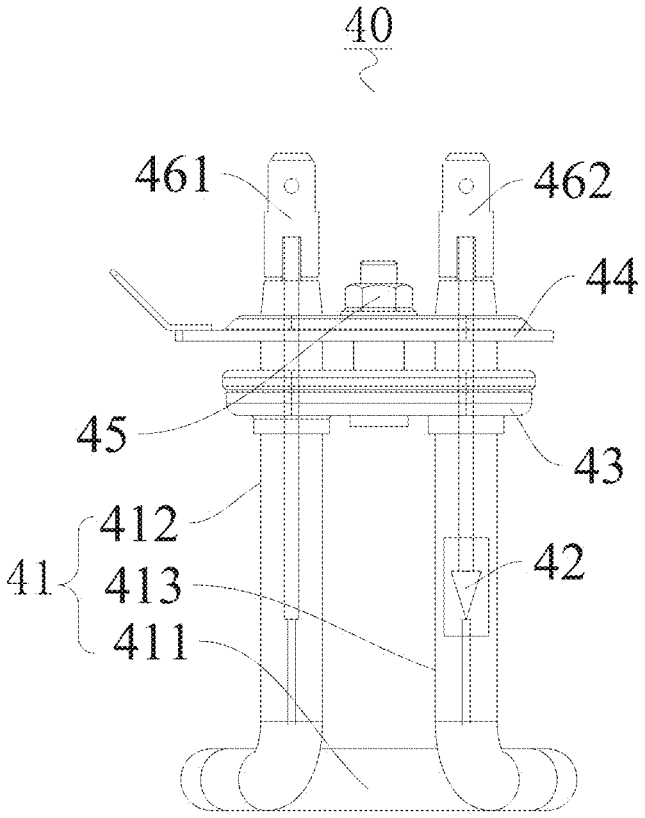
FIG. 3 is a schematic view of a heating assembly of a heat pump for a dishwasher according to an embodiment of the present disclosure.
Figure 4:
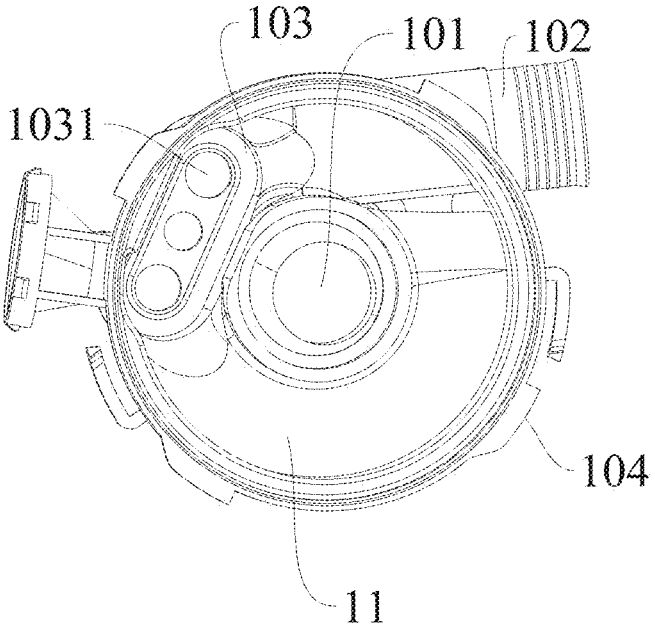
FIG. 4 is a schematic view of an upper pump casing of a heat pump for a dishwasher according to an embodiment of the present disclosure.

In some embodiments, as shown in FIG. 3, the heating assembly 40 includes a heating pipe 41, a fuse 42, and a heater wire (not shown) disposed in the heating pipe 4.

In some embodiments, the heating pipe 41 includes an arc-shaped portion 411, a first linear portion 412, and a second linear portion 413. The lower end of the first linear portion 412 is connected with a first end of the arc-shaped portion 411, and a lower end of the second linear portion 413 is connected with a second end of the arc-shaped portion 411. The heating pipe 41 is disposed in the chamber. Upper ends of the first and second linear portions 412, 413 both extend out of the pump casing. The fuse 42 is disposed in at least one of the first and second linear portions 412, 413. The arc-shaped portion 411 surrounds the extending part 302 and is spaced apart from the extending part 302.

In some embodiments, the pump casing includes an upper pump casing 11 and a lower pump casing 12. The upper and lower pump casings 11, 12 are detachably connected with each other. The inlet 101 and the outlet 102 are formed in the upper pump casing 11. The heating pipe 41 is disposed in the upper pump casing 11. The upper pump casing 11 is made of flame retardant material.

In some embodiments, the pressure switch assembly 50 is arranged on the outer wall of the pump casing and connected with the heating assembly 40.

With the heat pump for the dishwasher according to embodiments of the present disclosure, the extending part is encircled by the arc-shaped portion and spaced apart from the arc section, and the fuse is disposed in at least one of the first and second linear portions and remote from the arc section. Therefore, the length of the linear portion (such as the first and/or second linear portion) may be reduced, thus reducing the volume of the heat pump for the dishwasher. In addition, the heat pump for the dishwasher according to embodiments of the present disclosure may have three protection means, i.e. a pressure switch, a fuse, and a flame resistant pump casing. The pressure switch may be connected with the heating assembly in series. In a water-deficient condition, the pressure switch does not work and the heating assembly is disconnected with the pump casing. If a failure occurs to the pressure switch, the fuse in the interior of the heating assembly performs a protection function. With an upper pump casing made of flame retardant material, the heat pump may not burst into fire even in a limit condition. As described above, the heat pump according to embodiments of the present disclosure may have high safety and simple appearance, and may be made of relatively less material by using a relatively simpler molding process.

In some embodiments, the heater wire is disposed only in the arc-shaped portion 411. Further, the heating assembly 40 may further include a sealing member 43 (such as, a sealing piece) and a mounting piece 44. The upper ends of the first and second linear portions 412, 413 penetrates and extends beyond the sealing member 43 and the mounting piece 44, and the heating pipe 41 is arranged on the pump casing via the sealing member 43 and the mounting piece 44.

In some embodiments, as shown in FIG. 1, a mounting part 103 is disposed on the outer wall of the pump casing. The mounting part 103 defines a first through hole 1031 therein. The first and second linear portions 412, 413 both penetrates and extends beyond the mounting part 103 via the first through hole 1031. The sealing member 43 is disposed on the inner wall of the pump casing, the mounting piece 44 is disposed on the outer wall of the pump casing and corresponding with the position of the sealing member 43. The sealing member 43 and the mounting piece 44 are fixed on inner and outer walls of the pump casing via a bolt 45 which penetrates the sealing member 43, the pump casing, and the mounting piece 44 sequentially in turn from inside to outside.

In some embodiments, as shown in FIG. 3, the heating assembly 40 further includes a first connecting terminal 461 and a second connecting terminal 462. The first connecting terminal 461 is disposed above the upper end of the first linear portion 412 and connected with the heater wire via a first wire (not shown), and the second connecting terminal 462 is disposed above the upper end of the second linear portion 413 and connected with the heater wire via a second wire (not shown). The fuse 42 is connected with at least one of the first and second wires.

Figure 5:
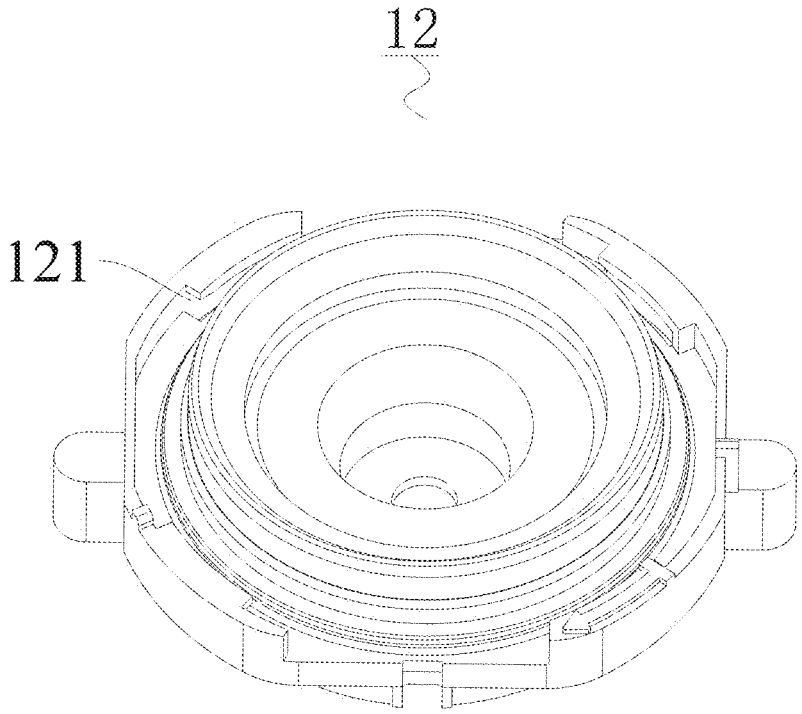
FIG. 5 is a schematic view of a lower pump casing of a heat pump for a dishwasher according to an embodiment of the present disclosure.

In some embodiments, as shown in FIG. 1, a plurality of snapping members 104 (such as protrusions) are disposed on an outer wall of the upper pump casing 11 along a peripheral of the pump casing and spaced apart from each other. As shown in FIG. 5, a plurality of snapping grooves 121 to be fit with the snapping members 104 are disposed in an inner wall of the lower pump casing 12 along the peripheral of the pump casing. In some embodiments, the snapping member includes an inclined portion and a flat portion connected with the inclined portion. With the snapping member and groove 104, 121 fitting with each other, the upper and lower pump casings 11, 12 may form a more compact pump casing for the heat pump.

Figure 2:
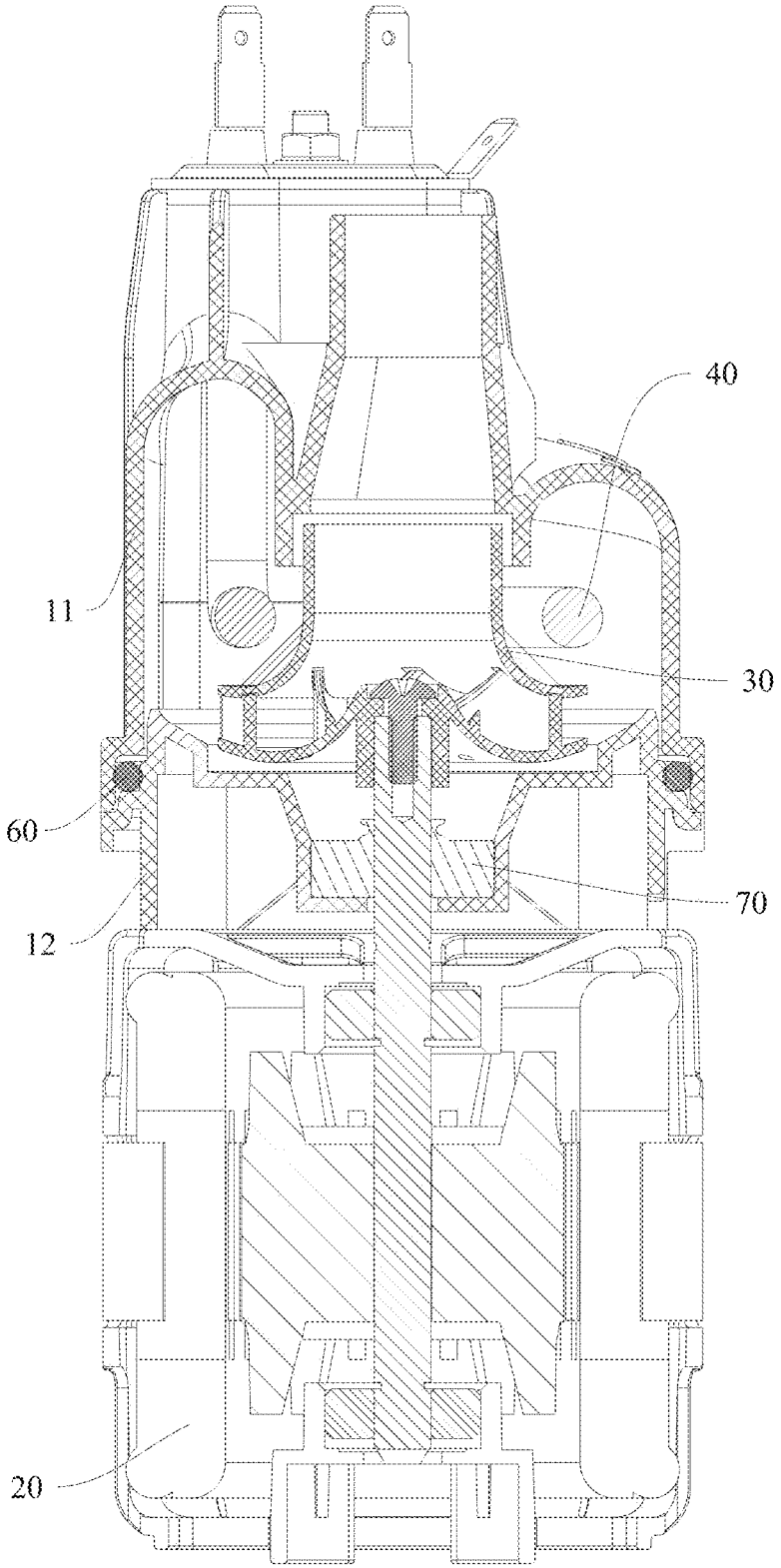
FIG. 2 is a schematic view of a heat pump for a dishwasher according to another embodiment of the present disclosure.

In some embodiments, as shown in FIGS. 1-2, a sealing ring is disposed between the upper and lower pump casings 11, 12. In some embodiments, a sealing frame 70 is disposed between the lower pump casing 12 and the impeller 30. The sealing frame 70 has a second through hole therein, and the rotatable shaft 201 penetrates the sealing frame 70 via the second through hole.

With the heat pump for a dishwasher according to embodiments of the present disclosure, the heating assembly includes the arc-shaped portion and the linear portion and has a simple appearance, thus ensuring the molding size of the heating assembly, and maintaining a relative uniform gap between the heating assembly and the impeller as well as a relative uniform gap between the heating assembly and the pump casing. The linear portion has a length efficient for mounting a common fuse, thus facilitating to control the assembling cost of the heating assembly. In addition, the heating assembly is placed between the inlet and the impeller, and the inner diameter of the arc-shaped portion is larger than that of the extending part of the impeller, and thereby the pump casing may be designed with a relatively smaller size.

Further, an axial involute vortex path of the upper pump casing and an upwardly inclined vortex path of the lower pump casing form a volute, which may enhance the efficiency of the heat pump. The fluid enters the impeller via the inlet, works via the revolving impeller, and flows to the involute vortex pump casing of the upper pump casing. Then the fluid is heated by the arc section, pressurized, and flows out of the pump casing via the outlet. Because the impeller makes high-speed revolution in the interior of the pump casing, the fluid works via the impeller and exchanges heat with the arc-shaped portion by completely contacting with the arc section, and thereby the heat exchanging efficiency is increased.

In the specification, it should be understood that, the terms such as "central", "longitudinal", "lateral", "width". "thickness". "above", "below", "front", "rear", "right", "left", "vertical", "horizontal", "top", "bottom", "inner", "outer", "clockwise", "counter-clockwise" should be construed to refer to the orientation as then described or as shown in the drawings. These terms are merely for convenience and concision of description and do not alone indicate or imply that the device or element referred to must have a particular orientation. Thus, it cannot be understood to limit the present disclosure.

In addition, terms such as "first" and "second" are used herein for purposes of description and are not intended to indicate or imply relative importance or significance or impliedly indicate quantity of the technical feature referred to. Thus, the feature defined with "first" and "second" may comprise one or more this feature. In the description of the present disclosure, "a plurality of" means two or more than two this features, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on." "above," or "on top of" a second feature may include an embodiment in which the first feature is right or obliquely "on," "above," or "on top of" the second feature, or just means that the first feature is at a height higher than that of the second feature; while a first feature "below," "under." or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment". "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments can not be construed to limit the present disclosure, and changes, alternatives, and modifications can be made in the embodiments without departing from spirit, principles and scope of the present disclosure.

What is claimed is:

1. A heat pump for a dishwasher, comprising:

a pump casing having a chamber defined with an inlet and an outlet, wherein the pump casing has a top surface in an axial direction;

a motor connected with the pump casing and having a rotatable shaft extended into the chamber in the axial direction;

an impeller disposed within the chamber and arranged on the rotatable shaft, which comprises a body part and an extending part having a diameter smaller than that of the body part;

a heating assembly comprising a heating pipe disposed in the chamber, a fuse, and a heater wire disposed in the heating pipe, wherein the heating pipe comprises an arc-shaped portion defining a first end and a second end, a first linear portion defining an upper end and a lower end connected with the first end of the arc-shaped portion, and a second linear portion defining an upper end and a lower end connected with the second end of the arc-shaped portion, wherein both the first linear portion and the second linear portion extend in the axial direction, the upper ends of the first and second linear portions are extended out of the top surface of the pump casing, the fuse is disposed in at least one of the first and second linear portions and is remote from the arc-shaped portion, and the extending part is encircled by and spaced apart from the arc-shaped portion; and a pressure switch assembly arranged on an outer wall of the pump casing and connected with the heating assembly.

2. The heat pump according to claim 1, wherein the heater wire is disposed in the arc-shaped portion.

3. The heat pump according to claim 1, wherein the heating assembly further comprises a sealing member and a mounting piece via which the heating pipe is mounted on the pump casing; and the sealing member and the mounting piece are penetrated by the upper ends of the first and second linear portions.

4. The heat pump according to claim 3, wherein a mounting part is disposed on an outer wall of the pump casing, which comprises a first through hole through which upper ends of the first and second linear portions are penetrated, wherein the sealing member and the mounting piece are disposed on inner and outer walls of the pump casing respectively and fixed on the pump casing via a bolt penetrating through the sealing member, the pump casing, and the mounting piece in turn.

5. The heat pump according to claim 1, wherein the heating assembly further comprises a first connecting terminal which is disposed on the upper end of the first linear portion and connected with the heater wire via a first wire; and a second connecting terminal which is disposed on the upper end of the second linear portion and connected with the heater wire via a second wire, wherein the fuse is connected with at least one of the first and second wires.

6. The heat pump according to claim 1, wherein the pump casing comprises an upper pump casing formed with the inlet and the outlet, and a lower pump casing detachable connected with the upper pump casing, and the upper pump casing is flame retardant with the heating pipe being disposed therein.

7. The heat pump according to claim 6, wherein a plurality of snapping members are formed on an outer wall of the upper pump casing circumferentially along the pump casing, a plurality of corresponding snapping grooves adapted to be mated with the plurality of the snapping members respectively are formed in an inner wall of the lower pump casing circumferentially along the pump casing.

8. The heat pump according to claim 7, wherein an upper surface of each snapping member comprises an inclined portion and a flat portion connected with the inclined portion.

9. The heat pump according claim 6, wherein a sealing ring is disposed between the upper and lower pump casings; and a sealing frame is disposed between the lower pump casing and the impeller, which is defined with a second through hole through which the rotatable shaft is penetrated.

10. A dishwasher, comprising:

a dishwasher housing and a heat pump within the dishwasher housing, wherein the heat pump comprises:

a pump casing having a chamber defined with an inlet and an outlet, wherein the pump casing has a top surface in an axial direction;

a motor connected with the pump casing and having a rotatable shaft extended into the chamber in the axial direction;

an impeller disposed within the chamber and arranged on the rotatable shaft, which comprises a body part and an extending part having a diameter smaller than that of the body part;

a heating assembly comprising a heating pipe disposed in the chamber, a fuse, and a heater wire disposed in the heating pipe, wherein the heating pipe comprises an arc-shaped portion defining a first end and a second end, a first linear portion defining an upper end and a lower end connected with the first end of the arc-shaped portion, and a second linear portion defining an upper end and a lower end connected with the second end of the arc-shaped portion, wherein both the first linear portion and the second linear portion extend in the axial direction, the upper ends of the first and second linear portions are extended out of the top surface of the pump casing, the fuse is disposed in at least one of the first and second linear portions and is remote from the arc-shaped portion, and the extending part is encircled by and spaced apart from the arc shaped portion; and a pressure switch assembly arranged on an outer wall of the pump casing and connected with the heating assembly.

11. The dishwasher according to claim 10, wherein the heater wire is disposed in the arc-shaped portion.

12. The dishwasher according to claim 10, wherein the heating assembly further comprises a sealing member and a mounting piece via which the heating pipe is mounted on the pump casing; and the sealing member and the mounting piece are penetrated by the upper ends of the first and second linear portions.

13. The dishwasher according to claim 12, wherein a mounting part is disposed on an outer wall of the pump casing, which comprises a first through hole through which upper ends of the first and second linear portions are penetrated, wherein the sealing member and the mounting piece are disposed on inner and outer walls of the pump casing respectively and fixed on the pump casing via a bolt penetrating through the sealing member, the pump casing, and the mounting piece in turn.

14. The dishwasher according to claim 10, wherein the heating assembly further comprises a first connected terminal which is disposed on the upper end of the first linear portion and connected with the heater wire via a first wire; and a second connected terminal which is disposed on the upper end of the second linear portion and connected with the heater wire via a second wire, wherein the fuse is connected with at least one of the first and second wires.

15. The dishwasher according to claim 10, wherein the pump casing comprises an upper pump casing formed with the inlet and the outlet, and a lower pump casing detachable connected with the upper pump casing, and the upper pump casing is flame retardant with the heating pipe being disposed therein.

16. The dishwasher according to claim 15, wherein plurality of snapping members are formed on an outer wall of the upper pump casing circumferentially along the pump casing, a plurality of corresponding snapping grooves adapted to be mated with the plurality of the snapping members respectively are formed in an inner wall of the lower pump casing circumferentially along the pump casing.

17. The dishwasher according to claim 16, wherein an upper surface of each snapping member comprises an inclined portion and a flat portion connected with the inclined portion.

18. The dishwasher according to claim 15, wherein a sealing ring is disposed between the upper and lower pump casings; and a sealing frame is disposed between the lower pump casing and the impeller, which is defined with a second hole through which the rotatable shaft is penetrated.

19. The heat pump according to claim 1, wherein the arc-shaped portion of the heating pipe is in a plane substantially perpendicular to the axial direction and wherein the first linear portion and the second linear portion of the heating pipe are substantially perpendicular to the arc-shaped portion.

20. The dishwasher according to claim 10, wherein the arc-shaped portion of the heating pipe is in a plane substantially perpendicular to the axial direction and wherein the first linear portion and the second linear portion of the heating pipe are substantially perpendicular to the arc-shaped portion.

* * * * *